United States Patent [19]

Le Chatelier

[11] 4,241,572

[45] Dec. 30, 1980

[54] ROTORS OF FREED-FIBER SPINNING DEVICES

[75] Inventor: Jacques Le Chatelier, Riedisheim, France

[73] Assignee: Societe Alsacienne de Constructions Mechaniques de Mulhouse, Mulhouse, France

[21] Appl. No.: 24,725

[22] Filed: Mar. 28, 1979

[30] Foreign Application Priority Data

May 9, 1978 [FR] France ..... 78 13620

[51] Int. Cl.[3] ..... D01H 7/888; D01H 7/885

[52] U.S. Cl. ..... 57/58.89; 57/302

[58] Field of Search ..... 57/58.89, 302, 58.95, 57/300, 301

[56] References Cited

U.S. PATENT DOCUMENTS

| | | | |
|---|---|---|---|
| 3,336,741 | 8/1967 | Zavadsky et al. | 57/58.89 |
| 3,357,168 | 12/1967 | Zlevor et al. | 57/58.89 |
| 3,367,099 | 2/1968 | Kubovy et al. | 57/58.89 |
| 3,798,886 | 3/1974 | Rajnoha et al. | 57/302 |
| 3,834,147 | 9/1974 | Havranek et al. | 57/58.89 |

*Primary Examiner*—Donald Watkins

*Attorney, Agent, or Firm*—Cantor and Singer

[57] ABSTRACT

The bottom wall of a cup-shaped rotor for a freed-fiber spinning device has a flat central portion surrounded by an inclined annular portion. The lateral wall of the cup has the shape of a cone frustum, the small diameter of which is located on the edge of the cup opening. Waste removal holes are formed in the annular portion of the bottom wall in the immediate vicinity of the lateral wall. Waste material is thus discharged to the exterior of the rotor under the action of centrifugal force.

3 Claims, 1 Drawing Figure

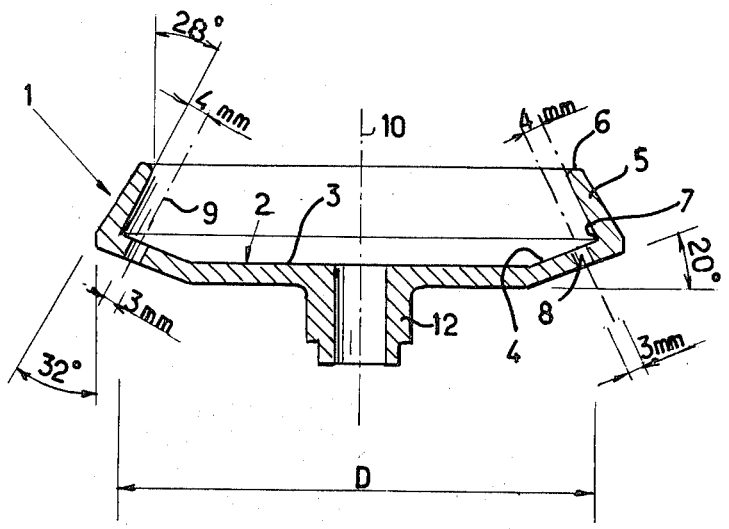
28°
1
4 mm
10
4 mm
6
5
9
2
3
7
20°
3mm
12
8
4
3mm
32°
D

ROTORS OF FREED-FIBER SPINNING DEVICES

This invention relates to the rotors of freed-fiber spinning devices of the type in which the rotor has the shape of a cup. The bottom wall of the cup has a flat central portion surrounded by an inclined annular portion which is raised towards the exterior. The lateral wall of the cup has the shape of a cone frustum, the small diameter of which is located on the edge of the cup opening, with the result that the maximum internal diameter of the cup is located between the bottom wall and the edge of this latter.

When spinning certain textile fibers and especially wool fibers, powdery deposits having a high degree of fineness and associated with vegetable debris rapidly appear in the channel of the rotor and cause disturbances in the spinning process.

The aim of the invention is to produce freed-fiber spinning rotors of this type which are not subject to the above-mentioned disadvantage of rotors of conventional types.

To this end, a rotor in accordance with the invention is characterized by the presence of waste removal holes formed in the aforementioned annular portion of the bottom wall of the rotor in the immediate vicinity of the lateral wall of said rotor. Under the action of centrifugal force, waste material is thus discharged to the exterior of the rotor through the holes formed in the bottom portion of this latter and is therefore no longer liable to interfere with the spinning process.

In one advantageous embodiment, the waste removal holes have the same angle of slope with respect to the axis of the rotor as that of the generator-lines of the lateral wall of said rotor. The holes have a diameter of the order of 3 mm and their axes are located at a distance of the order of 4 mm from the lateral wall of the rotor.

A more complete understanding of the invention will be gained from the following description and from a study of the accompanying drawings in which the single FIGURE is a diametrical sectional view and shows one embodiment of a freed-fiber spinning rotor in accordance with the invention.

The freed-fiber spinning rotor which is illustrated in the drawing is a part of revolution 1 having the shape of a cup. The bottom wall 2 of said cup has a flat central portion 3 surrounded by an inclined annular portion 4 which is raised towards the exterior through an angle of the order of 20° in the example shown. The lateral wall 5 of said cup is of frusto-conical shape, the small diameter of the cone frustum being located on the edge 6 of the opening of the cup. Thus the maximum internal diameter "D" of the cup is located between the bottom wall 2 and the edge 6 of this latter, at a point corresponding to the location of a channel 7.

Waste removal holes 8 which are eight in number in the example under consideration are formed in the annular portion 4 of the bottom wall 2 and in the immediate vicinity of the lateral wall 5 of the cup. In the embodiment which is illustrated, the axes 9 of said holes have the same angle of slope with respect to the axis 10 of the rotor as that of the generator-lines of the lateral wall 5 of the cup, namely an angle of the order of 28°. In the same example, said axes are located at a distance of the order of 4 mm from the lateral wall 5 of the cup and the holes have a diameter of the order of 3 mm.

The bottom wall 2 of the cup is provided with a hub 12 which serves to fix the rotor on a rotary supporting and driving shaft (not shown in the drawings) in accordance with any conventional arrangement.

During operation, the yarn which is being formed is in frictional contact with the bottom wall 2 of the rotor in the vicinity of the channel 7. This frictional contact is conductive to centrifugal displacement of dust particles to the point at which the yarn moves away from the wall of the rotor. Said particles are then subjected solely to the action of centrifugal force and can be discharged through the holes 8.

A structure of this type is particularly advantageous in devices for spinning freed fibers of relatively substantial length (at least 60 mm, for example) such as wool fibers.

What is claimed is:

1. A cup-shaped rotor for a freed-fiber spinning device in which the bottom wall of the cup has a flat central portion surrounded by an inclined annular portion which is raised towards the exterior whilst the lateral wall of said cup has the shape of a cone frustum whose small diameter is located on the edge of the cup opening and the maximum internal diameter of the cup is consequently located between the bottom wall and the edge of said cup, wherein waste removal holes are formed in the aforesaid annular portion of the bottom wall in the immediate vicinity of the lateral wall of said cup, the axes of said holes having the same angle of slope with respect to the axis of the rotor as the angle of slope of the generator-lines of the lateral wall of the cup.

2. A rotor as claimed in claim 1, wherein said holes have a diameter of the order of 3 mm and their axes are located at a distance of the order of 4 mm from the lateral wall of the cup.

3. A cup-shaped rotor for a freed-fiber spinning device in which the bottom wall of the cup has a flat central portion surrounded by an inclined annular portion which is raised towards the exterior whilst the lateral wall of said cup has the shape of a cone frustum whose small diameter is located on the edge of the cup opening and the maximum internal diameter of the cup is consequently located between the bottom wall and the edge of said cup, wherein waste removal holes are formed in the aforesaid annular portion of the bottom wall in the immediate vicinity of the lateral wall of said cup, said holes having a diameter of the order of 3 mm and their axes being located at a distance of the order of 4 mm from the lateral wall of the cup.

* * * * *